252-146 AU 166 EX
1/2/79 XR 4,132,568

United States Patent [19]
Irwin

[11] 4,132,568
[45] Jan. 2, 1979

[54] PROCESS AND COMPOSITION FOR PICKLING METAL SURFACES

[76] Inventor: David W. Irwin, 13236 Richards Dr., Strongsville, Ohio 44136

[21] Appl. No.: 861,114

[22] Filed: Dec. 16, 1977

[51] Int. Cl.² ..... B08B 3/08
[52] U.S. Cl. ..... 134/3; 134/41; 252/141; 252/142; 252/146
[58] Field of Search ..... 134/3, 10, 28, 41; 252/142, 141, 146; 148/6.24, 6.17

[56] References Cited

U.S. PATENT DOCUMENTS

| | | | |
|---|---|---|---|
| 1,321,182 | 11/1919 | Allen | 134/3 |
| 2,121,520 | 6/1938 | Curtin | 148/6.17 |
| 2,249,383 | 7/1941 | Hilty | 134/3 |
| 2,302,643 | 11/1942 | Thompson | 148/6.24 X |
| 2,313,925 | 3/1943 | Curtin | 148/6.24 X |
| 2,360,509 | 10/1944 | Morgan et al. | 134/3 X |
| 2,636,009 | 4/1953 | Irwin | 252/146 |
| 2,692,187 | 10/1954 | Chester et al. | 134/3 X |
| 2,692,188 | 10/1954 | Chester et al. | 134/3 X |
| 2,759,862 | 8/1956 | Henricks | 148/6.24 |
| 2,813,816 | 11/1957 | Otto | 148/6.24 |
| 2,831,814 | 4/1958 | Chester et al. | 134/3 X |
| 3,226,180 | 12/1965 | Irwin | 134/3 X |

FOREIGN PATENT DOCUMENTS 801033 7/1936 France.

OTHER PUBLICATIONS

Eaton, Photographic Chemistry, 1965, pp. 75-84.

*Primary Examiner*—Marc L. Caroff
*Attorney, Agent, or Firm*—Robert R. Hussey

[57] ABSTRACT

Metal surfaces are conditioned by subjecting the metal to the action of an acid pickling bath containing a pickling acid which reacts with the metal to condition the surface thereof. This reaction also produces hydrogen gas which forms a film on the surface of the metal which film inhibits the rate of reaction between the pickling acid and the metal. A compound capable of liberating elemental colloidal sulfur which reacts with the hydrogen gas to form hydrogen sulfide and thereby decrease the amount of the hydrogen film present to thereby increase the effectiveness of the pickling acid is added to the acid pickling bath. An effective amount of sodium sulfite is also added to the acid pickling bath to cause sodium thiosulfate to be produced in situ whereby the colloidal sulfur is maintained at a fine particulate size to thereby increase the effectiveness of the colloidal sulfur and consequently more effectively remove the hydrogen film from the surface of the metal to thereby further increase the effectiveness of the pickling acid.

26 Claims, No Drawings

PROCESS AND COMPOSITION FOR PICKLING METAL SURFACES

BACKGROUND OF THE INVENTION

1. Field of the Invention

The present invention relates to a process of treating metal in an acid pickling bath to condition the surface thereof and concerns the use of a novel additive for the acid pickling bath including a compound capable of liberating elemental colloidal sulfur and sodium sulfite and to compositions used in such a process.

2. Description of the Prior Art

The use of a compound capable of liberating colloidal sulfur in an acid pickling bath is well known in the acid pickling bath art and has been used extensively for many years. For example, Irwin discloses the use of sodium thiosulfate or a polysulfide in U.S. Pat. No. 2,636,009. As is generally known, various pickling baths are used to condition the surface of metal including the removal of various oxides, rust or scale and various surface contaminants on the metal. When the metal is so conditioned, subsequent operations such as plating, galvanizing, enameling and painting may be performed on the metal.

In general, acid pickling baths utilize sulfuric acid or hydrochloric acid as well as various combinations thereof. The prior art has recognized that when the acid attacks the undesirable surface on the metal, fissures or crack-like courses in the undesirable surface are developed until the acid reaches the base where the metal itself is more readily attacked. The longer the interval of the bath, the deeper such eating is directly into the metal to etch it away.

Hydrogen gas is generated by the chemical action of the acid on the iron and may be trapped about the crack or fissure to blast off scale particles. The hydrogen gas formed by the pickling acid reacting with the metal has a trait of spreading out or locating as a film coating over the metal and the residual scale or rust on the metal. The absorbed film of gas is too thin to have sufficient buoyancy to rise as a bubble and thus to escape from the bath.

The prior art has recognized the introduction into an acid pickling bath of a compound capable of liberating elemental colloidal sulfur. When the elemental colloidal sulfur is liberated, it reacts with the hydrogen gas to form hydrogen sulfide which escapes from the bath and thereby decreases the amount of the hydrogen film present. When the amount of the hydrogen film present is so decreased, the effectiveness of the pickling acid is increased since the pickling acid can more readily attack the surface of the metal.

The prior art has also recognized other various additional additives for use in conjunction with a compound capable of producing colloidal sulfur. Irwin, U.S. Pat. No. 2,692,187, shows the additional additive of chromium aldonate to act as catho-depolarizer of the couples formed on the surface of the metal which is being pickled. As a result the pickling action is exceedingly rapid and at the same time a uniform attack of the acid on the metal is obtained. In U.S. Pat. No. 2,692,188, an additional additive of a thiocyanate is disclosed to obtain a finely grained etched surface on the metal which is pickled. U.S. Pat. No. 2,831,814 discloses the additional additive a ferrocyanide to provide a whiter pickled product and in U.S. Pat. No. 3,226,180, the additional additive of an organic acid inhibitor is disclosed to decrease the weight loss of the base metal.

All of the systems described above perform satisfactorily to a certain degree and accelerate the rate of acid attack on the metal but it has been found that the present invention provides a system that has improved performance over the systems of the prior art.

Accordingly, it is the primary object of the invention to provide an improved process and additive for an acid pickling bath to condition the surface of metal and remove various oxides, rust or scale and various other surface contaminants on the metal.

Another object of the invention is to provide a process and additive to be used in conjunction with an acid pickling bath which is noted for its exceptional performance characteristics.

Another object of the invention is to provide an improved process and additive for an acid pickling bath whereby it is possible to decrease the temperature of the bath while maintaining the rate of acid attack at the same level as prior art baths which are operated at a higher temperature and thereby save energy.

A still further object of the invention is to provide an improved process and additive for an acid pickling bath which allows for lower acid concentrations, faster line speed and longer tank life.

It is still a further object of the invention to provide an improved process and additive for an acid pickling bath which allows the pickling bath to be effectively used for a longer period of time even though the bath has a higher iron value and lower acid value.

Other objects of the invention will become apparent to those skilled in the art from a reading of the following specification and claims.

SUMMARY OF THE INVENTION

The above objectives are accomplished in accordance with this invention by providing a pickling bath having added thereto a compound capable of liberating colloidal sulfur, preferably sodium thiosulfate, and an effective amount of sodium sulfite.

In one aspect, the present invention concerns an improved process for treating metal to condition the surface thereof by subjecting the metal to the action of an acid pickling bath containing (a) a pickling acid which reacts with the metal to condition the surface thereof and produces hydrogen gas which forms a film on the surface of the metal, which film inhibits the rate of reaction between the pickling acid and the metal, (b) a compound capable of liberating elemental colloidal sulfur which reacts with the hydrogen gas to form hydrogen sulfide and thereby decrease the amount of hydrogen film present to thereby increase the effectiveness of the pickling acid wherein the improvement comprises adding to the pickling bath an effective amount of sodium sulfite to cause sodium thiosulfate to be produced in situ whereby the colloidal sulfur is maintained at a fine particulate size to thereby increase the effectiveness of the colloidal sulfur and consequently more effectively remove the hydrogen film from the surface of the metal to thereby increase the effectiveness of the pickling acid.

In another aspect, the present invention concerns a method of conditioning the surface of a metallic article by providing a pickling bath having a pickling acid, adding a compound capable of liberating colloidal sulfur, and also adding an effective amount of sodium sulfite to improve the rate of acid attack on the metallic article, positioning the metallic article in the pickling bath until the surface of the metallic article is conditioned and removing the metallic article from the pickling bath.

In still another aspect, the present invention also concerns an additive for an acid pickling bath which consists essentially of a compound which is capable of liberating colloidal sulfur in an acidic aqueous media and sodium sulfite which additive may be added to an acid pickling bath of pickling acid and water to form a pickling bath for use in the practice of the invention.

DESCRIPTION OF THE PREFERRED EMBODIMENTS OF THE INVENTION

The present invention is preferably utilized in an acid pickling bath which is used to condition the surface of a metal including the removal of various oxides, rust or scale and various surface contaminants on the metal so that when the metal is so conditioned, subsequent operations such as forming plating, galvanizing, enameling and painting may be performed on the metal. In the practice of the present invention, a pickling bath is an aqueous bath having a pickling acid. It should be understood within the scope of this invention to use any acid which will remove the various oxides, rust or scale and various surface contaminants on the metal. Acids generally used in acid pickling baths are sulfuric acid and hydrochloric acid. The acid concentration used in a pickling bath is subject to variation depending on the particular type of acid employed. In the case of sulfuric acid, the general range of concentration is 1% to 25% by weight of $H_2SO_4$. In the case of hydrochloric acid, the general range of concentration is between 5% to 33% by weight HC1.

The pickling acid attacks the undesirable surface on the metal when it is positioned in the pickling bath. It is within the scope of the present invention to condition the surface of any metal and particularly ferrous metals. As the pickling acid attacks the metal, fissures or crack-like courses on the undesirable surface are developed and the pickling acid eats away the undesirable surface. The longer the interval of the bath, the deeper such eating is directly into the metal to etch it away. As the pickling acid attacks the metal and reacts with the metal, nascent hydrogen is generated by the chemical action of the acid on the metal and has a trait of spreading out or locating as a film coating over the metal and the residual oxide, rust, scale and various other surface contaminants on the metal. The absorbed film of gas is too thin to have sufficient buoyancy to rise as a bubble and thus escape from the metal surface.

It is within the scope of the present invention to add or introduce colloidal sulfur into the pickling bath either by means of depositing micron finely divided sulfur into the bath directly or adding a compound capable of liberating colloidal sulfur in the acid bath. The colloidal sulfur reacts with the hydrogen gas formed by the reaction of the pickling acid with the metal to form hydrogen sulfide, which escapes as a gas. The dispersed colloidal characteristic of micron fine sulfur possesses the reactive properties with hydrogen so that it picks up the hydrogen to decrease the amount of the hydrogen film on the metal surface being treated to allow the pickling acid to attack the metal more readily. In addition, the removal of hydrogen gas from the surface of the metal decreases any hydrogen embrittlement of the metal during the pickling process. This hydrogen film is so thin that it does not readily gather into droplet masses, and thus, of itself, does not tend to rise in the solution and be clear of the metal.

As described above, compounds may be used which will produce finely divided sulfur in suspension when added to an acid pickling bath. A polysulfide, such as sodium thiosulfate or sodium polysulfide, are compounds which are capable of liberating colloidal sulfur in an acid pickling bath. The employment of such a substance is not claimed herein per se, but is the subject of Irwin U.S. Pat. No. 2,636,009. A preferred compound liberating colloidal sulfur is sodium thiosulfate. It appears that only about 1/5 of the sodium thiosulfate is effective to produce colloidal sulfur in an acid pickling bath. For example, the amount of colloidal sulfur formed in a sulfuric acid pickling bath by adding one pound of a composition, having approximately 5.25% sodium thiosulfate, per 400 pounds of sulfuric acid is approximately 0.0105 pounds of colloidal sulfur per 400 pounds of the weight of the acid in the pickling bath. It is desirable to produce colloidal sulfur in amounts sufficiently small so that the colloidal sulfur liberated remains dispersed in colloidal form and does not coalesce and precipitate to thereby become ineffective for the purposes of the present invention.

It has been found that the present invention is operative with any minor addition of colloidal sulfur or a compound capable of liberating colloidal sulfur in an acid bath. In fact, it has been discovered when a colloidal sulfur or a compound capable of liberating sulfur and sodium sulfite is added to an acid pickling bath pursuant to the present invention, the amount of the colloidal sulfur may be decreased over the prior art practice which consequently decreases the costs of the additive. In the practice of the present invention, if the colloidal sulfur is introduced or added to the pickling bath by means of a compound capable of liberating colloidal sulfur, that compound should be capable of producing 0.002% to 1.0% of colloidal sulfur based on the weight of the acid in the bath. For example, if sodium thiosulfate is used in the present invention, it should be added to the pickling bath in amounts of about 0.01% to about 5% of the weight of the acid in the pickling bath. This amount of sodium thiosulfate is capable of producing from about 0.002% to about 1% of colloidal sulfur based on the weight of acid in the bath. As will be hereinafter described, it should be clearly understood that the sodium sulfite will decrease the amount of the colloidal sulfur actually present in the bath.

A pickling bath for use in the practice of the present invention more preferably includes the addition of colloidal sulfur or a compound capable of liberating colloidal sulfur in even smaller amounts. For example, if sodium thiosulfate is added to the pickling bath as a compound capable of liberating colloidal sulfur, the amount of sodium thiosulfate added to the bath is from about 0.5% to about 0.25% of the weight of the acid in the pickling bath. This amount of sodium thiosulfate is capable of producing from about 0.05% to about 0.10% of colloidal sulfur. It should be clearly understood that it is fully within the contemplation of this invention to directly introduce colloidal sulfur of micron fineness into the acid pickling bath. The amount of the colloidal sulfur introduced into the acid pickling bath is decreased as a result of the minor additions of sodium sulfite as more fully described hereinafter.

The present invention employs the use of sodium sulfite in the pickling bath to maintain the colloidal sulfur in fine particulate size which increases the effectiveness of the colloidal sulfur. The sodium sulfite reacts with the colloidal sulfur which is deposited or formed in the acid pickling bath as described above, to produce sodium thiosulfate. By this reaction, the tendency of the elemental colloidal sulfur particles to coalesce together and precipitate out of the acid pickling bath is minimized. It appears that the elemental colloidal sulfur is maintained at a finer particulate size and thereby provides colloidal sulfur with a greater effective surface. Accordingly, the finer particulate sulfur is capable of more effectively removing the inert hydrogen film from the surface of the metal to thereby further increase the effectiveness of the pickling acid.

By the reaction of the sodium sulfite with the colloidal sulfur to produce sodium thiosulfate, in effect sodium thiosulfate, which is a compound capable of liberating colloidal sulfur, is constantly "added" to the acid pickling bath. As described above, this reaction also substantially improves the effectiveness of the pickling acid by maintaining the smaller particulate size of the elemental colloidal sulfur. The sulfur tends to stay in suspension and thereby has its maximum effectiveness. In addition, since the colloidal sulfur particles are maintained at a finer size, their tendency to coagulate is decreased.

In order to clearly demonstrate the dramatic results of the present invention, tests were run on both high and low carbon steels. For purposes of illustration and comparison without limiting the present invention, three solutions were used in these tests, the first solution being a hydrochloric acid bath, the second solution being a hydrochloric acid bath and sodium thiosulfate as an additive, and the third solution being a hydrochloric acid bath with an additive of sodium thiosulfate and sodium sulfite. More particularly, the solutions used are as follows:

Solution I
- 250cc of water and
- 250cc of commercial grade (20 Baume') hydrochloric acid.

Solution II
- 250cc of water,
- 250cc of commercial grade (20 Baume') hydrochloric acid and
- 0.6cc of the following additive:
  - Water — 2700 pounds
  - Caustic Soda — 29 pounds
  - Dextrose — 288 pounds
  - Sodium Thiosulfate — 2015 pounds It can be noted from the above, that this additive contains 40.043% of sodium thiosulfate, by formula weight and consequently 1.6684% sodium thiosulfate based on the weight of acid in the solution which is capable of producing 0.334% of colloidal sulfur based on the acid weight of the solution. It should be further noted that the dextrose is an optional ingredient which is added as a reducing agent and the caustic soda is added to make the solution weakly alkaline to prevent decomposition of the sodium thiosulfate until the product is ready for use.

Solution III
- 250cc of water,
- 250cc of commercial grade (20 Baume') hydrochloric acid,
- 0.6cc of the following additive, with the percentage of each ingredient by formula weight marked opposite the ingredient:

| | | |
|---|---|---|
| Sodium Thiosulfate | 36 grams | 26.392% |
| Sodium Sulfite | 3.6 grams | 2.639% |
| Dextrose | 20 grams | 14.6% |

and adding sufficient water to provide 100cc of the above additive.

As noted above, this additve contains 26.392% of sodium thiosulfate and 2.639% of sodium sulfite. Consequently, the solution contains 1.2% based on the weight of the acid in the solution of sodium thiosulfate, and 0.1193% based on the weight of the acid in the solution, of sodium sulfite. Based on the above, the amount of the sodium thiosulfate added is capable of producing 0.24% colloidal sulfur based on the acid weight of the solution.

The following Chart 1 indicates the percentage of the weight loss of a low carbon steel (1006 grade) when immersed in the above-mentioned solutions at 72° Fahrenheit for a period of 30 minutes. The average percentage weight loss was determined by subtracting the weight of the work piece at the end of 30 minutes in the solution from its weight prior to immersion in the bath. This amount, which is the total weight loss, was divided by the original weight of the metallic article before it was immersed in the bath and the resultant multiplied by 100 to yield a percentage. Several of these tests were run to give an average percentage weight loss indicated in Chart 1.

The rate of acceleration was computed by assuming the average percentage weight loss in Solution I, a standard acid pickling bath with no additives, as a base and computing the increased percentage weight loss to show the accelerating effect of the minor additions of the additive taught by the present invention on an acid pickling bath.

CHART 1

| | Avg. % Wt. Loss | Rate of Acceleration |
|---|---|---|
| Solution I | 0.014 | 1 |
| Solution II | 0.085 | 6.07 |
| Solution III | 0.27 | 19.3 |
| Solution III after resting for a week with no pickling being done during that period of time | 0.095 | 6.8 |

The following Chart 2 indicates the results of the average percentage weight loss of a high carbon steel (1071 grade) when immersed in the above-mentioned solutions at 72° Fahrenheit for a period of 30 minutes with the average percentage of weight loss and rate of acceleration computed on the same basis as that described above in connection with Chart 1.

CHART 2

| | Avg. % Wt. Loss | Rate of Acceleration |
|---|---|---|
| Solution I | 0.034 | 1 |
| Solution II | 0.28 | 8.24 |
| Solution III | 1.06 | 31.2 |

As can be seen from above, when sodium thiosulfate is added in the above concentrations designated in Solution II to a hydrochloric acid pickling bath, the rate at which the acid attacks the metal is accelerated to a rate of 6.07 for a low carbon steel and 8.24 for a high carbon steel.

The dramatic results of the present invention are clearly illustrated by the substantial increase in the rate of acceleration of the acid attack of Solution III with respect to both a low carbon and a high carbon steel. In Solution III, the amount of sodium thiosulfate is reduced from approximately 40% to approximately 26% which accordingly will decrease the amount of colloidal sulfur introduced into the acid pickling bath with a very minor addition of sodium sulfite approximately 0.12% based on the weight of the acid. It will be noted from the above that in Solution II from an equal amount of the composition added 40.043% of the composition added or 1.6684% based on the weight of the acid was sodium thiosulfate in Solution II and in Solution III, 26.392% of the composition added or 1.2% based on the weight of the acid was sodium thiosulfate.

In Solution III, even though the amount of sodium thiosulfate was substantially decreased, with a minor addition of sodium sulfite the efficiency of the acid pickling bath was substantially increased. In fact, in the case of the low carbon material, the rate of acceleration of the acid pickling bath increased from 6.07 to 19.3 and in the case of the high carbon steel, the rate of acceleration increased from 8.24 to 31.2. This very substantial increase in the rate of acid attack on the metal placed in the pickling bath dramatically describes the substantial effect that the very minor addition of sodium sulfite has even when the amount of sodium thiosulfate added to the bath is decreased.

By decreasing the amount of sodium thiosulfate from approximately 40% of the additive described in Solution II to about 26% of the additive of Solution III and adding sodium sulfite in the approximate amount of 2.6% of the additive described in Solution III, the total amount of the sodium thiosulfate is decreased. Even the total amount of the sodium thiosulfate and sodium sulfite used in Solution III, is substantially decreased with respect to the amount of sodium thiosulfate in Solution II while substantially improved results are achieved. It can be seen from the above that the present invention provides an additive that is less costly than prior art additives.

Other objectives of this invention are met in that exceptional performance characteristics are achieved. Since the rate of acid attack on the metal is substantially increased by use of the additive disclosed by the present invention, the temperature of the acid pickling bath may be decreased while still maintaining at least the same rate of acid attack of the prior art bath, which consequently creates energy savings. In addition, lower acid concentrations may be used in the bath since the rate of acid attack is improved. To prolong tank life, the lower acid concentrations may be used in the bath with an additive of the present invention to provide the same rate of acid attack which will prolong the tank life. Furthermore, faster line speed of the metal passing through the bath may be utilized due to the higher rate of acid attack.

When the additive of the present invention is used, the pickling bath may be effectively used for a longer period of time even though the bath has a higher iron value and a lower acid value. This result is achieved since the additive of the present invention increases the rate of acid attack and effectively allows for operation of the pickling bath at lower acid values.

The effect that the sodium sulfite has on prolonging the effectiveness of the additive is clearly shown by the test performed in Chart 1 wherein Solution III was allowed to rest for a week. Even though the sodium thiosulfate generated colloidal sulfur and the sodium sulfite reacted with the colloidal sulfur to form additional sodium thiosulfate, once the amount of sodium sulfite was decreased through reaction with the colloidal sulfur, the action of the bath of Solution III still provided a rate of acceleration and an average percentage weight loss after one week at a rate in excess of Solution II having a substantially greater amount of sodium thiosulfate before the solution rested.

The above results with respect to Chart 1 clearly indicate that a substantial improvement is realized with the present invention. In fact, as pointed out above, even after a period of time is allowed to elapse to allow the sodium sulfite to react with the colloidal sulfur generated by the sodium thiosulfate, a very favorable and unexpected result is realized with respect to the rate of acceleration of the rate of which the acid attacks the metal. It is believed that this result is achieved by the cyclical reformation of the sodium thiosulfate from the colloidal sulfur as a result of putting sodium sulfite in the acid pickling bath.

In fact, it is within the contemplation of this invention to continually add amounts of sodium sulfite in sufficient quantities to continually reform sodium thiosulfate in the acid pickling bath so that the colloidal sulfur is maintained in the desired quantities as referred to hereinabove and also as will hereinafter be referred to. The sodium sulfite may be added in any form.

It is also within the contemplation of this invention to also continually add additives taught by this invention in such amounts so as to achieve desirable results.

In addition, it is within the contemplation of this invention to provide an additive which not only includes sodium thiosulfate, or any other compound capable of producing colloidal sulfur or colloidal sulfur of micron fineness, and sodium sulfite but also other compounds such as a chromium aldonate, a thiocyanate, a ferrocyanide, an organic acid inhibitor or other prior art additive compounds necessary to achieve the desired result.

It should be understood that it is within the contemplation of this invention to use any amount of sodium sulfite to achieve the desired results and that any amount of sodium sulfite, no matter how small, will be operative in the presence of colloidal sulfur to increase the rate of acid attack and other features of the present invention as described above.

In the preferred practice of the invention, the additive includes the addition of colloidal sulfur in the amounts of between 0.002% to 1% based on the weight of the acid in the bath and, if for example, sodium thiosulfate is used, the additive would include 0.01% to 5% of sodium thiosulfate based on the weight of the acid in the bath. This amount of sodium thiosulfate is capable of producing colloidal sulfur in the range from about 0.002% to about 1% based on the weight of the acid in the bath. The additive taught by the present invention would also preferably include from about 0.002% to about 1.3% of sodium sulfite based on the weight of the acid in the bath.

In the more preferred practice of the present invention, the additive would include the addition of colloidal sulfur in the amounts of from about 0.05% to about 0.1% based on the weight of the acid in the bath and, if for example, sodium thiosulfate is used, the additive would include 0.25% to 0.5% of sodium thiosulfate based on the weight of the acid in the bath. This amount of sodium thiosulfate is capable of producing colloidal sulfur in the range from about 0.05% to about 0.1% based on the weight of the acid in the bath. The additive taught by the present invention would also preferably include from about 0.02% to about 0.08% of sodium sulfite based on the weight of the acid in the bath.

In the practice of the present invention, the additive described above also includes chromium aldonate to act as a catho-depolarizer of the couples formed on the surface of the metal which is being pickled. In another practice of the present invention, the additive described above also includes thiocyanate to obtain a finely grained etched surface on the metal which is pickled. In yet another practice of the present invention, the additive described above also includes ferrocyanide. In still another practice of the present invention, the additive described above also includes an organic acid inhibitor.

By using the additive taught by the present invention, a method and process is provided for conditioning surfaces of metal articles, including the steps of providing a pickling bath, having a pickling acid which reacts with the metal to condition the surface thereof and produces hydrogen gas which forms an inert film on the surface of the metal, which film inhibits the rate of reaction between the pickling acid and the metallic article. The additive of the present invention is added including either sulfur of micron fineness or a compound capable of liberating colloidal sulfur and sodium sulfite to maintain the colloidal sulfur in fine particulate size and form sodium thiosulfate which consequently increases the effectiveness of the pickling bath. After the bath is so prepared, the metallic article is positioned in the pickling bath until the surface thereof is conditioned. After conditioning the surface of the metallic article by removing various oxides, rust, scale and various surface contaminants, the metal article is removed from the pickling bath.

As pointed out above, it should be understood that sodium sulfite may be continually or when periodically desired added to the bath while a number of different metallic articles are being conditioned to maintain the effectiveness of the additive. In addition, it is within the contemplation of this invention to either continually or periodically when desired add additional amounts of the additive taught by the present invention to maintain the effectiveness of the acid pickling bath.

While there have been described what are at present to be the preferred embodiments of this invention, it will be obvious to those skilled in the art that various changes and modifications may be made therein without departing from the invention, and it is, therefore, aimed in the appended claims to cover all such changes and modifications as fall within the true spirit and scope of the invention.

What is claimed is:

1. In a process for treating metal to condition a surface thereof including providing an acid pickling bath with which the metal is in contact, said acid pickling bath containing a pickling acid which reacts with the metal to condition the surface thereof and produces hydrogen gas which forms a film on the surface of the metal which film inhibits the rate of reaction between the pickling acid and the metal, said acid pickling bath also containing a compound which liberates elemental colloidal sulfur when in said acid pickling bath which colloidal sulfur reacts with the hydrogen gas to form hydrogen sulfide and thereby decrease the amount of hydrogen film present to thereby increase the effectiveness of the pickling acid, the improvement which comprises: said acid pickling bath also containing an amount of sodium sulfite effective to produce sodium thiosulfate in situ while the metal is in contact with said acid pickling bath whereby the colloidal sulfur is maintained at a fine particulate size to thereby increase the effectiveness of the colloidal sulfur and consequently more effectively remove the hydrogen film from the surface of the metal to thereby further increase the effectiveness of the pickling acid.

2. The process of claim 1 wherein said sodium sulfite is present in said bath in an amount ranging from about 0.002% to about 1.3% based on the acid weight of the bath.

3. The process of claim 1 wherein the compound which liberates elemental colloidal sulfur is present in an amount sufficient to produce elemental colloidal sulfur in a range from about 0.002% to about 1% based on the acid weight of the bath.

4. The process of claim 3 wherein the compound which liberates elemental colloidal sulfur is sodium thiosulfate which is present in an amount ranging from about 0.01% to about 5% based on the acid weight of the bath.

5. The process of claim 3 wherein said sodium sulfite is present in said bath in an amount ranging from about 0.002% to about 1.3% based on the acid weight of the bath.

6. The process of claim 1 wherein said sodium sulfite is present in an amount ranging from about 0.02% to about 0.08% based on the acid weight of the bath.

7. The process of claim 6 wherein the amount of the compound which liberates elemental colloidal sulfur is present in an amount sufficient to produce elemental colloidal sulfur in an amount ranging from about 0.05% to about 0.10% based on the acid weight of the bath.

8. The process of claim 7 wherein the compound which liberates elemental colloidal sulfur is sodium thiosulfate which compound is present in an amount ranging from about 0.25% to about 0.5% based on the acid weight of the bath.

9. The process of claim 1 wherein the compound which liberates elemental colloidal sulfur is a polysulfide.

10. The process of claim 9 wherein said polysulfide is sodium thiosulfate.

11. The process of claim 1 wherein the acid bath includes from about 1% to about 26% by weight of sulfuric acid, from about 0.01% to about 5% of sodium thiosulfate based on the acid weight of the bath and from about 0.002% to about 1.3% of sodium sulfite based on the acid weight of the bath.

12. The process of claim 1 wherein the acid bath includes from about 5% to about 33% by weight of hydrochloric acid, from about 0.01% to about 5% of sodium thiosulfate based on the acid weight of the bath and from about 0.002% to about 1.3% of sodium sulfite based on the acid weight of the bath.

13. In a process for treating metal to condition a surface thereof including providing an acid pickling bath with which the metal is in contact, said acid pickling bath containing a pickling acid which reacts with the metal to condition the surface thereof and produces hydrogen gas which forms a film on the surface of the metal which film inhibits the rate of reaction between the pickling acid and the metal, said acid pickling bath also containing elemental colloidal sulfur which reacts with the hydrogen gas to form hydrogen sulfide and thereby decrease the amount of hydrogen film present to thereby increase the effectiveness of the pickling acid, the improvement which comprises: said acid pickling bath also containing an amount of sodium sulfite effective to produce sodium thiosulfate in situ while the metal is in contact with said acid pickling bath whereby the colloidal sulfur is maintained at a fine particulate size to thereby increase the effectiveness of the colloidal sulfur and consequently more effectively remove the hydrogen film from the surface of the metal to thereby further increase the effectiveness of the pickling acid.

14. The process of claim 13 wherein said sodium sulfite is present in said bath in an amount ranging from about 0.002% to about 1.3% based on the acid weight of the bath.

15. The process of claim 14 wherein the elemental colloidal sulfur is present in a range from about 0.002% to about 1% based on the acid weight of the bath.

16. The process of claim 13 wherein said sodium sulfite is present in an amount ranging from about 0.02% to about 0.08% based on the acid weight of the bath.

17. The process of claim 16 wherein the elemental colloidal sulfur is present in an amount ranging from about 0.05% to about 0.10% based on the acid weight of the bath.

18. A method of conditioning a surface of a metallic article which includes the steps of, providing a pickling bath having a pickling acid which reacts with the metal to condition the surface thereof and produces a hydrogen gas which forms an inert film on the surface of the metal which film inhibits the rate of reaction between the pickling acid and the metallic article and positioning the metallic article in said pickling bath until the surface of the metallic article is conditioned, and removing the metallic article from said pickling bath, and adding to the pickling bath, before the step of removing the metallic article from said pickling bath, an additive including a compound which liberates colloidal sulfur when in said pickling bath which colloidal sulfur reacts with the hydrogen gas to form hydrogen sulfide and thereby decrease the inert hydrogen film to consequently increase the effectiveness of the pickling acid and sodium sulfite in an amount effective to maintain the colloidal sulfur in a fine particulate size to thereby increase the effectiveness of the colloidal sulfur and consequently effectively remove the inert hydrogen film from the surface of the metal to thereby further increase the effectiveness of the pickling acid and to react with the colloidal sulfur to form sodium thiosulfate which is a compound capable of liberating colloidal sulfur.

19. The method of claim 18 which includes the step of adding additional amounts of the additive to the pickling bath.

20. The method of claim 18 including the step of adding additional amounts of sodium sulfite to the pickling bath.

21. The method of claim 18 wherein said additive is present in said bath in sufficient amounts so that the compound which liberates colloidal sulfur is present in an amount ranging from about 0.01% to about 5% based on the acid weight of the bath and the sodium sulfite is present in an amount ranging from about 0.002% to about 1.3% based on the acid weight of the bath.

22. The method of claim 18 wherein said additive is present in said bath in sufficient amounts so that the compound which liberates colloidal sulfur is present in an amount ranging from about 0.25% to about 0.5% based on the acid weight of the bath and the sodium sulfite is present in an amount ranging from about 0.02% to about 0.08% based on the acid weight of the bath.

23. An additive for an acid pickling bath which when added to the acid pickling bath improves the rate of attack of the pickling acid on a metallic article when in contact with said bath said additive comprising a compound which liberates colloidal sulfur in an acidic aqueous media and sodium sulfite in an amount effective to produce sodium thiosulfate in situ and to maintain the colloidal sulfur at a fine particulate size to thereby increase the effectiveness of the colloidal sulfur and consequently increase the effectiveness of the pickling acid and chromium aldonate in an amount effective to act as a cathodepolarizer of the couples formed on the surface of a metallic article when in contact with said bath.

24. An additive for an acid pickling bath which when added to the acid pickling bath improves the rate of attack of the pickling acid on a metallic article when in contact with said bath said additive comprising a compound which liberates colloidal sulfur in an acidic aqueous media and sodium sulfite in an amount effective to produce sodium thiosulfate in situ and to maintain the colloidal sulfur at a fine particulate size to thereby increase the effectiveness of the colloidal sulfur and consequently increase the effectiveness of the pickling acid and a thiocyanate in an amount effective to produce a finely grained etched surface on the metallic article.

25. An additive for an acid pickling bath which when added to the acid pickling bath improves the rate of attack of the pickling acid on a metallic article when in contact with said bath said additive comprising a compound which liberates colloidal sulfur in an acidic aqueous media and sodium sulfite in an amount effective to produce sodium thiosulfate in situ and to maintain the colloidal sulfur at a fine particulate size to thereby increase the effectiveness of the colloidal sulfur and consequently increase the effectiveness of the pickling acid and a ferrocyanide in an amount effective to whiten the surface of a metallic article when in contact with said bath.

26. An additive for an acid pickling bath which when added to the acid pickling bath improves the rate of attack of the pickling acid on a metallic article when in contact with said bath said additive comprising a compound which liberates colloidal sulfur in an acidic aqueous media and sodium sulfite in an amount effective to produce sodium thiosulfate in situ and to maintain the colloidal sulfur at a fine particulate size to thereby increase the effectiveness of the colloidal sulfur and consequently increase the effectiveness of the pickling acid and an organic acid inhibitor in an amount effective to decrease the weight loss of the base metal of the metallic article.

* * * * *